United States Patent [19]

Ochi et al.

[11] Patent Number: 5,074,940

[45] Date of Patent: Dec. 24, 1991

[54] COMPOSITION FOR GAS GENERATING

[75] Inventors: Kouji Ochi; Kazuyuki Narita; Kazunori Matsuda, all of Aichi, Japan

[73] Assignee: Nippon Oil and Fats Co., Ltd., Japan

[21] Appl. No.: 716,898

[22] Filed: Jun. 18, 1991

[30] Foreign Application Priority Data

Jun. 19, 1990 [JP] Japan ..... 2-160241

[51] Int. Cl.[5] ..... C06B 35/00

[52] U.S. Cl. ..... 149/35; 149/110; 149/114; 149/21

[58] Field of Search ..... 149/21, 35, 110, 114

[56] References Cited

U.S. PATENT DOCUMENTS

| | | | |
|---|---|---|---|
| 3,920,575 | 11/1975 | Shiki et al. | 149/35 |
| 3,996,079 | 12/1976 | DiValentin | 149/35 |
| 4,376,002 | 3/1983 | Utracki | 149/35 |
| 4,533,416 | 8/1985 | Poole | 149/35 |
| 4,604,151 | 8/1986 | Knowlton et al. | 149/35 |
| 4,931,111 | 6/1990 | Poole et al. | 149/35 |

FOREIGN PATENT DOCUMENTS

| | | |
|---|---|---|
| 5613735 | 10/1974 | Japan . |
| 63166427 | 12/1986 | Japan . |

*Primary Examiner*—Stephen J. Lechert, Jr.
*Attorney, Agent, or Firm*—Stetina and Brunda

[57] ABSTRACT

A gas generating composition comprises an azide of an alkali metal or an alkaline earth metal, and manganese dioxide for oxidizing the azide. The composition further includes a clay material containing at least 37% by weight of silicon dioxide and having a mixing ratio of at least 5.5% by weight. This composition can allow burning to be conducted at low temperature to ensure the generation of the desired gas. The strength of a pellet of the composition can be improved without generating a toxic gas or reducing the burning rate or reducing the working efficiency in producing the pellet.

16 Claims, No Drawings

COMPOSITION FOR GAS GENERATING

BACKGROUND OF THE INVENTION

This application claims the priority of Japanese Patent Application No. 2-160241 filed June 19, 1990, which is incorporated herein by reference.

1. Field of the Invention

The present invention relates to the composition of a gas generating agent for use in a gas generator for inflating an air bag.

2. Description of the Related Art

A folded air bag is installed in the steering wheel of a vehicle. When an accident occurs, gas is supplied to the air bag to inflate it, thereby protecting the driver and passengers.

The gas generator, which supplies gas to the air bag, retains a pellet of a gas generating agent consisting of, for example, an azide and an oxidant. Burning this gas generating agent generates nitrogen gas which inflates the air bag.

The gas generating agent must burn very quickly since the air bag should inflate within several tens of milliseconds after the ignition starts. If the burning rate of the gas generating agent is not high enough, the pellet of the gas generating agent are often made thinner to increase the burning surface area.

In addition, the amount of toxic gas released from the gas generator, such as carbon monoxide or cyanides, should be kept below a certain concentration or at the level which can not be detected.

As the pellet of the gas generating agent will inevitably experience violent vibrations and/or severe temperature conditions involving a significant temperature changes, the pellet should maintain a sufficient strength to endure such conditions.

It is known that the addition of a binder increases the strength of the pellets of the gas generating agent. Binders are generally classified into organic binders and inorganic binders. Various organic binders are, however, unsuitable for mixing with gas generating agents for the following reason.

The carbon component in organic binders is liable to cause the formation of carbon monoxide or cyanides during the burning process of the gas generating agent and thus generates toxic gas. Particularly, cyanides are extremely poisonous so that even a slight amount thereof should not be generated.

Various prior art has been developed in consideration of this point. Japanese Patent Publication No. Sho 56-13735 discloses a gas generating composition having a compound represented by the following general formula I, formulated into a gas generating agent containing an azide and an oxidant:

$$(Al_2O_3)_m(M_xO)_n(SiO_2)_p \cdot qH_2O \qquad \text{I}$$

where M represents Li, Na, K, Sr, Mg or Ca, x is either 1 or 2, m and n are 0 or a positive number (provided that m and n are not 0 at the same time); p is a positive number and q is 0 or a positive number.

As a specific example of the compound represented by the formula I, the Japanese publication discloses aluminum silicate, magnesium silicate, magnesium aluminate silicate, water glass and their combination. All of these compounds are synthesized products. This gas generating composition is effective at improving the strength of the pellet of a gas generating agent.

The gas generating composition disclosed in the Japanese publication has, however, a disadvantage in that the burning rate drops with an increase in the amount of the compound represented by the formula I added. This is apparent from the fact that the inflating time for the air bag, as disclosed in the publication, increases with an increase in the amount of the compound added.

When the burning rate is slow, inflating the air bag within a predetermined period of time requires that the pellet be made thinner to increase the burning surface area. This method, however, reduces the strength of the pellet. There is no advantage to adding an inorganic binder to improve the pellet strength if such a measure slows the burning rate.

Japanese Unexamined Patent Publication No. Sho 63-166427 discloses a gas generating composition containing an azide as a main component and 2 to 6% by weight of graphite fiber. More specifically, this document discloses the following composition:

| | |
|---|---|
| sodium azide | 61 to 68% by weight |
| sodium nitrate | 0 to 5% by weight |
| bentonite | 0 to 5% by weight |
| iron oxide | 23 to 28% by weight |
| fumed silica | 1 to 2% by weight |
| graphite fiber | 2 to 6% by weight |

According to the composition, addition of the graphite fiber improves the pellet strength without reducing the burning rate.

Generally, in processing a gas generating composition into a pellet, a predetermined amount of a gas generating agent is supplied to the forming chamber of a commercially available tablet making machine and is compressed therein. At that time, in order to stably produce pellets with a given amount of chemicals and a given thickness, the gas generating agent before compression needs to have a fluid characteristic. In general, therefore, the gas generating agent is produced in the form of granules of the size of 0.1 to 1.0 mm.

Since the above composition has a fibrous material, such as graphite fiber, added, the gas generating agent cannot have good flowability. This makes it difficult to provide the desired granular form, resulting in an undesirable reduction of the working efficiency in producing pellets of a gas generating agent.

U.S. Pat. No. 3,996,079 discloses a gas generating composition having an azide, nickel oxide or iron oxide as an oxidant, and a small amount (0.5 to 3.0%) of a clay material. The clay material is effective in improving the efficiency of molding the gas generating agent.

Since this gas generating composition employs nickel oxide or iron oxide as an oxidant, the oxidizing reaction speed is slow, preventing the improvement of the burning rate.

U.S. Pat. No. 4,931,111 discloses a gas generating composition comprising (a) about 50to 70% by weight of an azide, (b) about 2 to 30% by weight of a first oxidant consisting of a metal oxide and (c) about 2 to 40% by weight of a burning rate controlling agent consisting of a second oxidant comprising nitrate or perchlorate, and a clay material (the ratio of the second oxidant to the clay material is 1:1 to 1:8). The burning rate of this composition is fast and gas generated from the burning has less toxicity.

This gas generating composition has a strong oxidant, such as nitrate or perchlorate, added thereto in order to acquire the desired performance. This causes a strong reaction to thereby raise the reaction temperature. In this case, the temperature of the generated gas becomes higher than what will result from the use of only a metal oxide as an oxidant. This requires that a cooling means be provided within the gas generator, so that the gas generator cannot be designed compact and lighter.

There is also a known composition which uses manganese dioxide as an oxidant to be mixed with an azide. However, a chemical property of azides is that when they are reacted with a heavy metal, such as copper, lead, silver and mercury, they are easily explosively ignited. Therefore, they are so sensitive that they should be treated with extreme care. The reaction of any azide with a heavy metal should therefore be avoided. Natural manganese ore, which is used as the raw material for manganese dioxide, contains a considerable amount of impurities, such as copper and lead. In order to mix the manganese dioxide acquired from the manganese ore with an azide, therefore, the manganese dioxide should be purified sufficiently to eliminate the heavy-metal impurity.

A typical method of refining manganese dioxide is to temporarily reduce it to manganese monoxide which is soluble in sulfuric acid, then selectively oxidize only the manganese monoxide in the bath of sulfuric acid. This purification process is preferred in that the heavy-metal impurity is eliminated to the degree of 10 ppm or below. The use of the sulfuric acid bath however causes the refined product to contain 4 to 5% of water, or adhesive water and bound water.

As a result, the composition having the manganese dioxide, produced through the above purification process, formulated into an azide has the disadvantage that it generates gas after burning, which contains a large amount of ammonia gas that has an bad odor while having a slight toxicity.

SUMMARY OF THE INVENTION

It is therefore an object of the present invention to provide a gas generating composition which is burnt at low temperature to ensure generation of the desired gas.

It is another object of the present invention to provide a gas generating composition which can improve the strength of its pellet without producing a toxic gas and reducing the burning rate or reducing the working efficiency at the time the pellet is produced.

To achieve the above objects, the gas generating composition embodying the present invention contains an azide of an alkal metal or alkaline earth metal, and manganese dioxide for oxidizing the azide. The composition further contains at least 40% by weight of silicon dioxide and a clay material whose mixing ratio is at least 5.5% by weight.

The constituting elements of the composition of the present invention will be described below one by one. The azide to be used in a gas generating composition of the present invention includes an alkali metal or an alkaline earth metal. The former includes lithium azide, sodium azide, potassium azide, rubidium azide and cesium azide, and the latter includes calcium azide, magnesium azide, strontium azide, and barium azide. Among them, sodium azide is the most suitable in light of the safety at the time it is handled, thermal safety and cost. To ensure a high burning rate, it is preferable that the azides, particularly, the sodium azide, have a particle size of 20 μm or smaller.

As an oxidant used with the sodium azide, manganese dioxide is selected in view of its low cost as well as its low burning temperature, high burning rate and good chemical stability at the time it is mixed with the sodium azide.

The manganese dioxide, if burnt in an electric furnace, for example, is suitable. Preburning of the manganese dioxide will remove water, particularly, bound water, therefrom. When the gas generating composition containing the manganese dioxide is burnt, therefore, the generation of ammonia based on the water in the gas after the burning is suppressed.

The burning temperature is preferably 250° to 500° C., and is more preferably 300° to 400° C. If the burning temperature is lower than 250° C., water cannot be removed sufficiently, whereas if the burning temperature exceeds 500° C., the manganese dioxide is decomposed to release oxygen and becomes dimanganese trioxide ($Mn_2O_3$) while water can be eliminated. This dimanganese trioxide works less as an oxidant than the manganese dioxide, and cannot provide a sufficiently high burning rate when mixed with an azide. It is suitable to set the particle size of the manganese dioxide to 10 μm or less in order to provide a high burning rate.

Since it is unnecessary to use a strong oxidant, such as a nitrate or perchlorate, for the gas generating composition containing such burnt manganese dioxide, a strong oxidizing reaction will not occur. Accordingly, the burning temperature becomes lower, yielding low-temperature gas. Unlike the prior art, therefore, it is unnecessary to provide a cooling means within a gas generator, which allows the gas generator to be compact and light.

The optimal mixing ratio of manganese dioxide to an azide differs depending on the type of the azide in use. If sodium azide is used as the azide, the ratio is preferably 25 to 60% by weight of the manganese dioxide to 40 to 75% by weight of the sodium azide.

A clay material containing a predetermined amount of silicon dioxide is added to the gas generating composition of the present invention to improve the general bonding strength of the gas generating composition and thus improve the strength of the composition. If the clay material containing 37% by weight or more of silicon dioxide is used, the oxidizing reaction rate of the gas generating composition when burnt can be set to the proper value to improve the strength of the composition without dropping the burning rate. In addition, since no organic binder is employed, a toxic component, such as carbon monoxide and cyanides, will not be produced when the gas generating agent is burnt. Moreover, since the gas generating composition contains no fibrous material, such as graphite fiber, the working efficiency in producing the gas generating composition will not be hindered.

The "clay material" in the present invention means a silicate mineral naturally produced or a material essentially consisting of the same, and it is preferred that the clay material has an average particle size of 4 μm or less. While a clay material is known to have different properties depending on where it is produced and what it contains, the clay material to be used in this invention includes those containing 37% by weight or greater of silicon dioxide, preferably 50% by weight or greater thereof. The maximum amount of the silicon dioxide is preferably 70% by weight. If the ratio of the silicon dioxide is 37% by weight or less, the burning rate will decrease.

Specifically, as the clay material, there can be used alone or combination of those selected from the group consisting of kaolinite [$Al_2Si_2O_5(OH)_4$, containing 40 to 60% by weight of silicon dioxide], pyrophyllite (containing 60% by weight of silicon dioxide), bentonite (containing 60 to 70% by weight of silicon dioxide), smectite (containing 40 to 60% by weight of silicon dioxide), montmorillonite (for example, containing 59.7% by weight of silicon dioxide), illite (for example, containing 51.2% by weight of silicon dioxide), halloysite and talc (for example, containing 37.6% by weight of silicon dioxide for each), and the like.

For example, in the case where talc containing 37.6% by weight of silicon dioxide is used and the mixing ratio of the talc is determined to be 5.5% by weight or more, the strength of the pellet will be improved.

If kaolinite containing 40 to 70% by weight of silicon dioxide, for example, 46.6% by weight thereof, is used in a clay material and the mixing ratio of the kaolinite is determined to be 5.5% by weight or greater, the pellet strength will be apparently improved, while the burning rate will not prominently drop.

Further, in the case where bentonite containing 60% by weight or greater of silicon dioxide, for example, 61.2% by weight thereof, is used in a clay material containing and the mixing ratio of the bentonite is determined to be 5.5% by weight or greater, the pellet strength will be apparently improved, and the burning rate will increase though slightly, compared to a bentonite-free composition.

The mixing ratio of the clay material in the gas generating agent of the present invention is 5.5% by weight or greater, and is preferably in the range of 5.5 to 30% by weight. If the amount of the clay material is less than 5.5% by weight, it is difficult to improve the pellet strength so that this clay material is not suitable. When the amount of the clay material exceeds 30% by weight, however, the pellet strength will not be improved while the burning rate tends to drop. As the mixing ratio of an azide decreases relative to an increase in the amount of the clay material, many pellets of a gas generating agent should be placed in the gas generator. This case is therefore unsuitable in that the size and weight of the generator will inevitably increase.

If the amount of the clay material is 5.5 to 30% by weight, the pellet strength will be improved as this amount increases. Depending on the mixed composition of an azide and an oxidant, however, if the amount of the clay material exceeds 15% by weight, the burning rate tends to gradually drop. It is therefore preferable that the amount of the clay material be 5.5 to 15% by weight. In this range, the use of bentonite is most suitable in that a slight improvement of the burning rate is apparent.

The following is an example of a suitable mixing ratio of each component of the gas generating composition of the present invention:

| | |
|---|---|
| azide | 52 to 72% by weight |
| burnt manganese dioxide | 22 to 42% by weight |
| clay material | 6 to 20% by weight |

A more suitable example of the mixing ratio is:

| | |
|---|---|
| azide | 55 to 65% by weight |
| burnt manganese dioxide | 30 to 38% by weight |
| clay material | 6 to 10% by weight |

The most suitable composition is one which contains an azide and a burnt manganese dioxide set in a stoichiometric ratio and a clay material, which constitutes 6 to 10% by weight of the whole composition.

EXAMPLES AND COMPARISON EXAMPLES

Examples embodying the present invention will now be described and compared to various comparison examples. In the description below, "% by weight" and "part(s) by weight" will be referred simply as "%" and "part(s)", respectively.

COMPARISON EXAMPLE F1

A proper amount of water/acetone was added to a composition containing 66.2% of sodium azide, 28.3% of iron dioxide, 5.5% of kaolinite (average particle size of 3.2 μm), followed by mixing for about 20 minutes by a mixing machine of Shinagawa type. The mixture was passed through a 32 mesh silk net to provide an agent for producing particles with a particle size of about 0.5 mm. After this agent was dried, a disk-shaped pellet, 6 mm in diameter and 3 mm thick, was produced using a rotary type tablet making machine.

Besides the production of this pellet, a rod-molded article (hereinafter called a "strand") of a size of 5 mm×8 mm×50 mm, was prepared with the above-mentioned agent using a special mold and a manual oil hydraulic pressing machine.

The strength of the pellet was determined using a pellet pressure strength testing machine. The test was conducted six times at the same dropping height, and the strength was expressed for each time by the maximum height beyond which the pellet would be broken. The ball used in this test is a bearing steel ball weighing 16.7 g.

The strand above mentioned was used for measurement of the burning rate. After the sides of the strand was coated with an epoxy resin for protection against the entire burning, two small holes were bored at the proper interval in the strand along its length using a drill 0.5 mm in diameter, and fuses for measurement of the burning time were put through the holes. This strand sample was placed on a fixed table, and was ignited from one end with a nichrome heating wire at a pressure of 30 atmosphere. The moment at which each fuse was melted when the burning surface passed thereby was electrically measured. The burning rate of the strand was determined on the basis of the distance between the two points (two holes) and the time difference between when these two fuses were respectively melted. The results of the test are shown in Table 1 below.

COMPARISON EXAMPLES F2 TO F6

Gas generating compositions containing the components shown in Table 1 were prepared in the same method as used in Comparison Example F1, and the properties of the compositions were evaluated in the same manner as in Comparison Example F1. Table 1 also shows the results of the evaluation.

In Table 1, $NaN_3$ is a product of Fujimoto Chemical Co., Ltd. The average particle size of $NaN_3$ was 9.63 μm. As the iron dioxide, "MAPICO" R-516, a product of Titan Industries, Ltd, was used, while kaolinite used was a product of Wako Pure Chemical Industries, Ltd.

As is apparent from Table 1, while the pellet strength increases in accordance with the mixing ratio of kaolinite in each Comparison Example, the burning rate drops. To use the composition as a gas generating agent, it should have a pellet strength of 9 cm or more and a burning rate of 21 mm/sec or faster. The gas generating agents of the individual Comparison Examples are not suitable for such a use.

EXAMPLES 1 TO 6

Gas generating compositions of individual Examples 1 to 6 were prepared in the same method as employed in Comparison Example F1 with the components as shown in Table 2 below except that kaolinite serving as a clay material was changed to bentonite (average particle size of 1.4 μm), and an iron dioxide as an oxidant was changed to an unburnt manganese dioxide. The properties of the compositions were evaluated in the same manner as in Comparison Example F1. The results of the evaluation are given in Table 2.

COMPARISON EXAMPLE M1

A composition consisting only of 65% of sodium azide and 35% of manganese dioxide was produced in the same method as employed in Example 1, and the properties of the composition were evaluated in the same manner as in Example 1. Table 2 shows the results of the evaluation.

COMPARISON EXAMPLE M2

A composition shown in Table 2 (Comparison Example M2) was produced in the same method as employed in Example 1 except that the weight of bentonite was changed to what is shown in Table 2, and the properties of the composition were evaluated in the same manner as in Example 1. Table 2 shows the results of the evaluation.

In Table 2, "FMH", an electrolytic manganese dioxide produced by Tosoh Corporation, was used as manganese dioxide used in the Examples and "Kunigeru VA", a product of Kunimine Industries, Ltd. was used as bentonite. The bentonite contains 60 to 70% of silicon dioxide. The average particle size of the manganese dioxide was 2.11 μm. The specific surface area of the manganese dioxide was measured 50.7 $m^2/g$ by the BET method (method of acquiring the amount of adsorption equilibrium using the adsorbing property of gas such as nitrogen, and calculating the specific surface area based on the obtained amount).

As apparent from Table 2, in Examples 1 to 6 where bentonite was added in the formulation ratio of 5.5 to 30%, both the pellet strength and the burning rate are improved as compared with those of Comparison Examples F1 to F6, M1 and M2. The improved values satisfy the aforementioned practical conditions (pellet strength: 9 cm or greater; and burning rate: 21 mm/sec or faster). The burning rate marks the peak in the case where 15% of bentonite is added, and it does not drop even when 25% of bentonite is added.

If less than 5.5% of bentonite is added (Comparison Examples M1 and M2), the pellet strength decreases, while, even in the case of 30% of bentonite added (Example 4), the burning rate is much faster than the rates for Comparison Examples F1 to F6. Therefore, 5.5% or greater is adequate for the amount of bentonite to be added.

EXAMPLE 7

A gas generating composition comprising 55.3% of sodium azide, 29.7% of manganese dioxide and 15% of talc (produced by Kunimine Industries, Ltd.) was produced in the same method as employed in Comparison Example F1, and the properties of the composition were evaluated in the same manner as in Comparison Example F1. As the result, the pellet strength was 10 cm in terms of the dropping height, and the burning rate was 29.9 mm/sec, both lying in the practical range.

EXAMPLE 8

A composition comprising 55.3% of sodium azide, 29.7% of manganese dioxide, 5% of kaolinite and 10% of bentonite was produced in the same method as employed in Comparison Example F1 and the properties of the composition were evaluated in the same manner as in Comparison Example F1. The pellet strength was improved to be 13 cm in terms of the dropping height, and the burning rate was increased to be 43.4 mm/sec.

EXAMPLE 9

A composition comprising 55.3% of sodium azide, 29.7% of manganese dioxide and 15% of water glass (a reagent produced by Wako Pure Chemical Industries, Ltd.) was produced in the same method as employed in Comparison Example F1 and the properties of the composition were evaluated in the same manner as in Comparison Example F1. The pellet strength was 13 cm in terms of the dropping height, and the burning rate was 26.0 mm/sec, both lying in the practical range.

Examples in which a burnt manganese dioxide was used as an oxidant and Comparison Examples will now be described.

EXAMPLE 11

Manganese dioxide (trade name, "FMH") was burnt in an electric furnace at atmospheric pressure and 400° C. for two hours. Water/acetone was added to a composition consisting of 61.2% of sodium azide (produced by Fujimoto Chemical Co., Ltd.), 32.8% of the burnt manganese dioxide and 6.0% of bentonite (trade name, "Kunigeru VA" containing 61.2% of silicon dioxide), and the mixture was then blended by a mixing machine of Shinagawa type for 20 minutes.

The mixture was passed through a 32 mesh silk net to prepare an agent for providing granules about 0.5 mm in diameter. The agent for granules was dried, and 1.0 g of the agent was fired and burnt in a P-202 type sealing container, a calorimeter of Shimadzu Corporation. Subsequently, gas produced from the burning of the agent was then collected in a one-liter teddler pack produced by Sanko Plastic Co., Ltd. Ammonia gas concentration was measured with a gas detecting tube of Kitagawa type (the measuring range: 5 to 260 ppm) of Komei Science Industries, Ltd.

Next, a disk-shaped pellet of 6 mm in diameter and 3 mm thick was prepared from the dried agent by a rotary type tablet making machine. Further, besides the pellet, a strand of 5 mm×8 mm×50 mm was prepared using a mold for an exclusive use and a manual oil hydraulic pressing machine.

The pellet strength and the burning rate of the strand were measured in the same manner as in Comparison Example F1. Table 3 shows the results of the measurement.

EXAMPLES 12 TO 14

Gas generating compositions were produced using the components shown in Table 3 in the same method as employed in Example 11 except that the amount of bentonite added was changed. The properties of the compositions were evaluated in the same manner as in Example 11. Table 3 also shows the results of the evaluation.

EXAMPLES 15 AND 16 AND COMPARISON EXAMPLE M3

Gas generating compositions were produced using the components shown in Table 3 in the same method as employed in Example 11 except that bentonite was replaced by kaolinite (a reagent produced by Wako Pure Chemical Industries, Ltd., containing 46% of silicon dioxide). The properties of the compositions were evaluated in the same manner as in Example 11. Table 3 also shows the results of the evaluation. It is to be noted that no clay material was added in Comparison Example M3.

As apparent from Table 3, the pellet strength and burning rate of the gas generating compositions in Examples 11 to 16 are kept high. In addition, the generation of an ammonia gas hardly occurred in these Examples, whereas with an unburnt manganese dioxide used as in Examples 5 and 6 in Table 2, 60 ppm of an ammonia gas was generated. When kaolinite containing a small amount of silicon dioxide was used (Examples 15 and 16), the pellet strength and the burning rate fell within the allowable range though slightly lowered. Further, when no clay material was mixed (Comparison Example M3), the pellet strength significantly dropped, making this comparison example impractical.

EXAMPLE 17

The same manganese dioxide as used in the aforementioned Example 11 was burnt in an electric furnace under the atmospheric pressure at 250° C. for 4 hours. A gas generating composition comprising 66.9% of barium azide $BaN_6$, a reagent produced by Wako Pure Chemical Industries, Ltd.), 27.1% of the burnt manganese dioxide, and 6.0% of montmorillonite ("Kunipia F", trade name, produced by Kunimine Industries, Ltd.; containing 59.7% of silicon dioxide) was produced in the same method as employed in Example 11. The properties of the composition were evaluated in the same manner as in Example 11. Table 4 shows the results of the evaluation.

EXAMPLES 18 TO 21 AND COMPARISON EXAMPLE M4

Gas generating compositions were produced using the components shown in Table 4 in the same method as employed in Example 11 except that the amount of montmorillonite added was changed. The properties of the compositions were evaluated in the same manner as in Example 11. Table 4 also shows the results of the evaluation.

EXAMPLE 22

A gas generating composition was produced using the components shown in Table 4 in the same method as employed in Example 11 except that montmorillonite was replaced by kaolinite. The properties of the compositions were evaluated in the same manner as in Example 11. Table 4 also shows the results of the evaluation.

As is apparent from Table 4, the generation of an ammonia gas hardly occurred in Examples 17 to 22, and the pellet strength and the burning rate are within the practical range. On the other hand, in the case where an unburnt manganese dioxide was used as in Example 6, the concentration of an ammonia gas was 40 ppm, slightly higher than those of Examples 17 to 22. When kaolinite containing a small amount of silicon dioxide was used (Example 22), the pellet strength and the burning rate fell within the practical range though slightly lowered. In Comparison Example M4 in which the amount of montmorillonite formulated is 6% or less, the pellet strength is low, making this comparison example impractical.

EXAMPLE 23

Manganese dioxide (the aforementioned product "FMH") was burnt in an electric furnace under the atmospheric pressure at 200° C. for 4 hours. A gas producing composition using the same components as in the aforementioned Example 11 was produced using this burnt manganese dioxide by the same method as employed in Example 11, and the properties were evaluated in the same manner as in Example 11. The evaluation showed relatively good results such that the pellet strength was 9 cm with the strand burning rate of 44.3 mm/sec. The concentration of an ammonia gas was 50 ppm.

EXAMPLE 24

Manganese dioxide (the aforementioned product "FMH") was burnt in an electric furnace under the atmospheric pressure at 550° C. for 2 hours. A gas producing composition using the same components as in the aforementioned Example 11 was produced using this burnt manganese dioxide by the same method as employed in Example 11, the properties were evaluated in the same manner as in Example 11. The results of the evaluation showed the 5-ppm concentration of an ammonia gas, the pellet strength of 9 cm with the strand burning rate of 26.2 mm/sec, all in the practical range.

TABLE 1

| Compared Example | Gas generating composition (%) | | | Pellet strength in height (cm) | Strand burning rate (mm/s) |
|---|---|---|---|---|---|
| | $NaN_3$ | Iron dioxide | Kaolinite | | |
| F1 | 67.9 | 29.1 | 3.0 | 3 | 20.7 |
| F2 | 66.2 | 28.3 | 5.5 | 5 | 20.7 |
| F3 | 63.0 | 27.0 | 10.0 | 8 | 19.9 |
| F4 | 59.5 | 25.5 | 15.0 | 9 | 18.5 |
| F5 | 52.5 | 22.5 | 25.0 | 10 | 9.9 |
| F6 | 49.0 | 21.0 | 30.0 | 10 | 6.7 |

TABLE 2

| Example and Compared Example | Gas generating composition (%) | | | | | Ammonia gas concentration (ppm) | Pellet strength in height (cm) | Strand burning rate (mm/s) |
|---|---|---|---|---|---|---|---|---|
| | $NaN_3$ | Burnt $MnO_2$ | Unburnt $MnO_2$ | Bentonite | Kaolinite | | | |
| Comp. M1 | 65.0 | — | 35.0 | — | — | — | 8 | 43.0 |
| M2 | 63.1 | — | 33.9 | 3.0 | — | — | 8 | 44.6 |
| Exam. 1 | 61.5 | — | 33.0 | 5.5 | — | — | 12 | 45.8 |
| 2 | 55.3 | — | 29.7 | 15.0 | — | — | 13 | 46.1 |
| 3 | 48.8 | — | 26.2 | 25.0 | — | — | 13 | 43.2 |
| 4 | 45.5 | — | 24.5 | 30.0 | — | — | 14 | 32.5 |
| 5 | 61.2 | — | 32.8 | 6.0 | — | 60 | 12 | 44.5 |
| 6 | 66.9 | — | 27.1 | 6.0 | — | 40 | 11 | 31.1 |

TABLE 3

| Example and Compared Example | Gas generating composition (%) | | | | | Ammonia gas concentration (ppm) | Pellet strength in height (cm) | Strand burning rate (mm/s) |
|---|---|---|---|---|---|---|---|---|
| | $NaN_3$ | Burnt $MnO_2$ | Unburnt $MnO_2$ | Bentonite | Kaolinite | | | |
| Exam. 11 | 61.2 | 32.8 | — | 6.0 | — | 5 or less | 12 | 43.8 |
| 12 | 58.6 | 31.4 | — | 10.0 | — | 5 or less | 14 | 42.6 |
| 13 | 55.4 | 29.6 | — | 15.0 | — | 5 or less | 15 | 42.0 |
| 14 | 52.1 | 27.9 | — | 20.0 | — | 5 or less | 15 | 41.2 |
| 15 | 61.2 | 32.8 | — | — | 6.0 | 5 or less | 9 | 38.2 |
| 16 | 55.4 | 29.6 | — | — | 15.0 | 5 or less | 12 | 29.7 |
| Comp. M3 | 65.0 | 35.0 | — | — | — | 5 or less | 5 | 41.9 |

TABLE 4

| Example and Compared Example | Gas generating composition (%) | | | | | Ammonia gas concentration (ppm) | Pellet strength in height (cm) | Strand burning rate (mm/s) |
|---|---|---|---|---|---|---|---|---|
| | $BaN_6$ | Burnt $MnO_2$ | Unburnt $MnO_2$ | Montmorillonite | Kaolinite | | | |
| Exam. 17 | 66.9 | 27.1 | — | 6.0 | — | 5 or less | 11 | 29.5 |
| 18 | 64.1 | 25.9 | — | 10.0 | — | 5 or less | 12 | 29.9 |
| 19 | 60.5 | 24.5 | — | 15.0 | — | 5 or less | 12 | 29.6 |
| 20 | 56.9 | 23.1 | — | 20.0 | — | 5 or less | 13 | 29.0 |
| 21 | 53.4 | 21.6 | — | 25.0 | — | 5 or less | 13 | 21.8 |
| 22 | 66.9 | 27.1 | — | — | 6.0 | 5 or less | 9 | 24.0 |
| Comp. M4 | 68.3 | 27.7 | — | 4.0 | — | 5 or less | 6 | 29.4 |

What is claimed is:

1. A gas generating composition comprising:
an azide of an alkaline metal or an alkaline earth metal;
manganese dioxide for oxidizing the azide; and
a clay material containing not less than 37% by weight of silicon dioxide and having a mixing ratio of not less than 5.5% by weight.

2. A gas generating composition according to claim 1, wherein the azide has a particle size of 20 μm or smaller.

3. A gas generating composition according to claim 1, wherein the manganese dioxide has a particle size of 10 μm or smaller.

4. A gas generating composition according to claim 1, wherein the clay material has an average particle size of 4 μm.

5. A gas generating composition according to claim 1, wherein the azide is an azide of an alkali metal.

6. A gas generating composition according to claim 5, wherein the alkali metal is sodium.

7. A gas generating composition according to claim 1, wherein the azide is an azide of an alkaline earth metal.

8. A gas generating composition according to claim 1, wherein the manganese dioxide has been burnt at a temperature in the range of 250° to 500° C.

9. A gas generating composition according to claim 8, wherein the manganese dioxide has been burnt at a temperature in the range of 300° to 400° C.

10. A gas generating composition according to claim 1, wherein the clay material is bentonite containing at least 60% by weight of silicon dioxide.

11. A gas generating composition according to claim 1, wherein the clay material is montmorillonite containing at least 50% by weight of silicon dioxide.

12. A gas generating composition according to claim 1, wherein the gas generating composition has a strength to endure a drop test by which a 16.7-g steel ball is dropped from a height of less than 9 cm toward a disk-shaped sample prepared from the composition.

13. A gas generating composition according to claim 1, wherein the gas generating composition is burnt at a rate of 21 mm/sec or faster in a case where a strand burning rate of a rod sample prepared from the composition is measured.

14. A gas generating composition comprising:
an azide mixed at a ratio of 52 to 72% by weight;
manganese dioxide mixed at a ratio of 22 to 42% by weight; and
a clay material mixed at a ratio of 6 to 20% by weight.

15. A gas generating composition according to claim 14, wherein the gas generating composition comprises:
sodium azide mixed at a ratio of 55 to 65% by weight;

a burnt manganese dioxide mixed at a ratio of 30 to 38% by weight; and bentonite mixed at a ratio of 6 to 10% by weight.

16. A gas generating composition comprising:

sodium azide having a particle size of 20 μm or smaller and a mixing ratio of 55 to 65% by weight;

a burnt manganese dioxide burnt at a temperature in the range of 300° to 400° C. and having a particle size of 10 μm or smaller and a mixing ratio of 30 to 38% by weight; and bentonite having an average particle size of 4 μm or smaller and a mixing ratio of 6 to 10% by weight.

* * * * *